US006289539B1

(12) United States Patent
Alpern

(10) Patent No.: US 6,289,539 B1
(45) Date of Patent: Sep. 18, 2001

(54) HANDRAIL ATTACHMENTS FOR BEDS

(76) Inventor: Erwin A. Alpern, 5040 Fulton St. NW., Washington, DC (US) 20026

( * ) Notice: Subject to any disclaimer, the term of this patent is extended or adjusted under 35 U.S.C. 154(b) by 0 days.

(21) Appl. No.: 09/464,109

(22) Filed: Dec. 16, 1999

(51) Int. Cl.[7] ..... A61G 7/053
(52) U.S. Cl. ..... 5/662; 5/81.1 R; 5/659
(58) Field of Search ..... 5/429, 430, 426, 5/424, 425, 428, 662, 81.1 R, 503.1, 658, 659; 297/411.31; 182/106

(56) References Cited

U.S. PATENT DOCUMENTS

| | | | | |
|---|---|---|---|---|
| D. 433,856 | * | 11/2000 | Blum | D6/503 |
| 2,904,799 | * | 9/1959 | Berlin | 5/426 |
| 3,176,322 | * | 4/1965 | Mulcahy | 5/503.1 |
| 3,474,473 | * | 10/1969 | Hannaberg | 5/426 |
| 6,138,301 | * | 10/2000 | Battiston | 5/81.1 R |

* cited by examiner

*Primary Examiner*—Lynne H. Browne
*Assistant Examiner*—Fredrick Conley

(57) ABSTRACT

A handrail attachment for beds comprises an upstanding side member connected to a base member adapted to fit under a bed mattress. The side member is in the form of an inverted U-shaped tubular member with cross-members mounted between the depending arms of the U-shaped tubular member. The end of one depending arm has a pivot pin mounted therein to permit the handrail to be swung away from the bed in open position, and the other end has a slidable rod mounted therein. The base member has upstanding end portions, one of which receives the pivot pin, and the other of which receives the slidable rod which locks the upstanding side member to the base member. The base member has elongated U-shaped support members mounted at either end thereof to extend under the bed mattress and be fastened to the opposite bed rail. A slidable rod with a series of spaced holes serves as an adjustable leg to support the handrail in open position. A removable plate is attached to the handrail to provide a support for items such as a telephone or TV remote control.

4 Claims, 3 Drawing Sheets

HANDRAIL ATTACHMENTS FOR BEDS

BACKGROUND OF THE INVENTION

The present invention relates to an improved handrail attachment for beds that provides a support structure for the bed occupant to utilize in climbing in and out of the bed and in shifting positions while in the bed. The attachment also functions as a guard rail that pivots in and out of position to permit ready access for making the bed and ministering to the needs of the bed occupant. When the attachment is pivoted outwardly, a leg support member is provided to add stability and enable the handrail, in its extended position, to serve as a support structure for the occupant when getting in and out of the bed. The attachment device also provides a convenient removable support for a telephone, television remote control, notepad, etc.

The present invention is an improvement over the structure shown in U.S. Pat. No. 5,463,784, issued to Erwin A. Alpern on Nov. 7, 1995. The device shown in the prior patent has met an existing need for devices of this nature, but has lacked a number of salient features contained in the present invention.

In accordance with the present invention, a handrail attachment for beds comprises an inverted U-shaped tubular handrail member disposed in a vertical plane along the side of a bed. A pair of cross-members extend between and are attached to the vertically depending arms of the inverted U-shaped tubular member. A base member having two U-shaped tubular portions is provided to slide under the bed mattress and be held in position by the mattress, the weight of the bed occupant, and removable fastening means such as a pair of flexible strap members. The strap members wrap around the U-shaped portions of the base member and the bed rail on the side of the bed opposite to the handrail attachment to anchor the assembly in position. Upstanding end portions of the base member having cross-sectional shapes similar to the ends of the inverted U-shaped tubular member are adapted to abut the ends of the inverted U-shaped tubular member and be locked in position.

SUMMARY OF THE INVENTION

A pivot pin member is fixedly mounted in the end of one of the depending arms of the inverted U-shaped tubular member. This pin member fits into one of the upstanding end portions of the base member to form a pivotal connection enabling the inverted U-shaped tubular member to be moved into an open position away from the bed. The other depending arm of the inverted U-shaped tubular member has a first slidable rod member depending from its lower end to slide into the other upstanding end portion of the base member to lock the inverted U-shaped tubular member in position alongside the bed. The first slidable rod member has a protruding knob member located near the upper end to protrude through a modified L-shaped slot in the said other depending arm of the inverted U-shaped tubular member, thereby serving to hold the first slidable rod member in an upper position where it will allow the inverted U-shaped tubular member to swing freely away from the bed. A straight tubular member is mounted on the depending arm of the inverted U-shaped tubular member containing the first slidable rod. A second slidable rod is positioned within the straight tubular member to serve as a support leg when the handrail is swung into an open position away from the bed. The second slidable rod has a series of holes spaced along its length to permit adjustment of the rod to accommodate different bed heights. The adjustment is accomplished by means of a bolt extending through the straight tubular member and a selected hole in the second slidable rod to lock them together in the selected position.

The plurality of cross-members extending between the depending arms of the inverted U-shaped tubular member provide structural stability and additional support means to be grasped by the bed occupant in shifting position in the bed. The cross-members may be made vertically adjustable to suit the needs of the bed occupant. A removable plate member having a curved top portion is designed to fit over the top of the inverted U-shaped tubular member. The removable plate member has a depending curved tab fastened to the rear side in position to fit in a snug relationship over the higher cross-member and be held in position by a thumbscrew extending through a threaded hole on the tab to engage the cross-member. The removable plate member may be made of a ferrous metal so that magnets can be utilized to hold memos against the plate, thereby allowing the removable plate to function as a message board. It is also contemplated that removable fastening means such as flexible hook and eye fabric fasteners be utilized to attach such items as a telephone, television remote control, etc., within easy reach of the bed occupant.

The novel features that are considered to be characteristic of the invention are set forth in particular in the appended claims. However, the invention itself, both as to construction and method of operation, will be understood best from the following description of the preferred mode for carrying out the invention, when read in connection with the accompanying drawings.

BRIEF DESCRIPTION OF THE DRAWINGS

The invention will now be described by way of example and with reference to the accompanying drawings in which.

DESCRIPTION OF THE INVENTION

Figure 1:
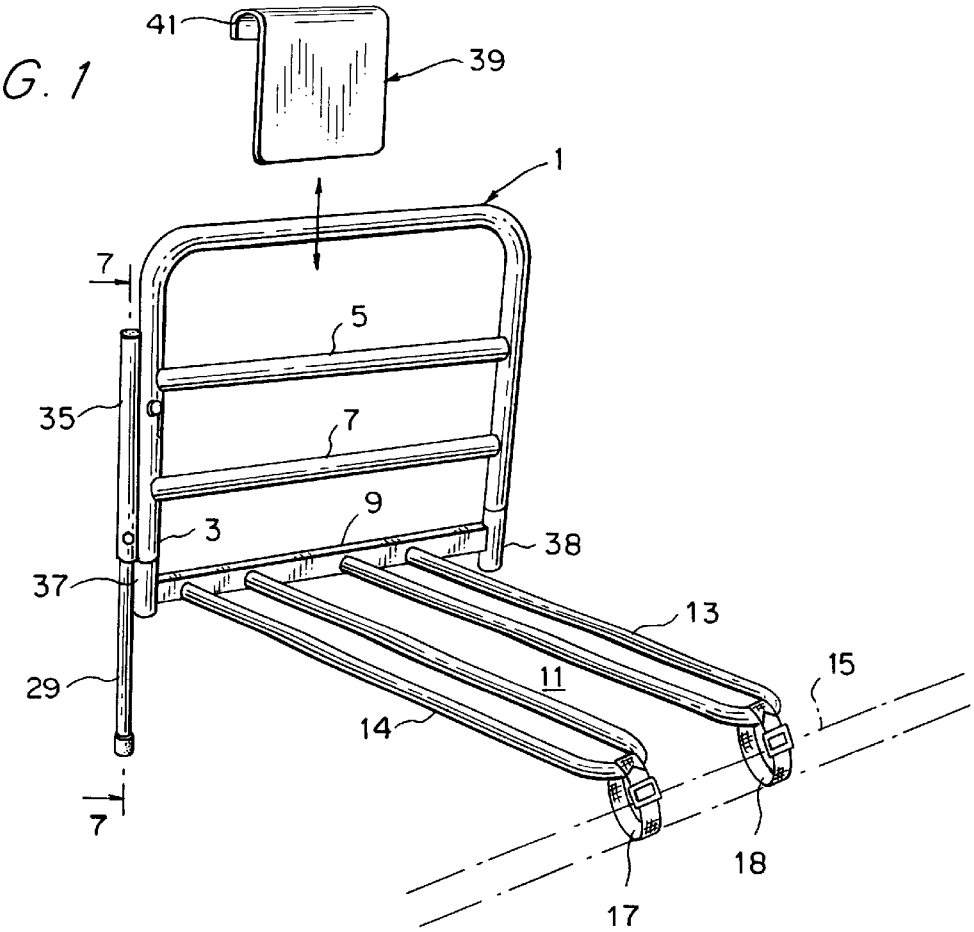
FIG. 1 is a perspective view of a preferred embodiment of the invention in which a handrail attachment in closed position is strapped to a bed rail.
Figure 2:
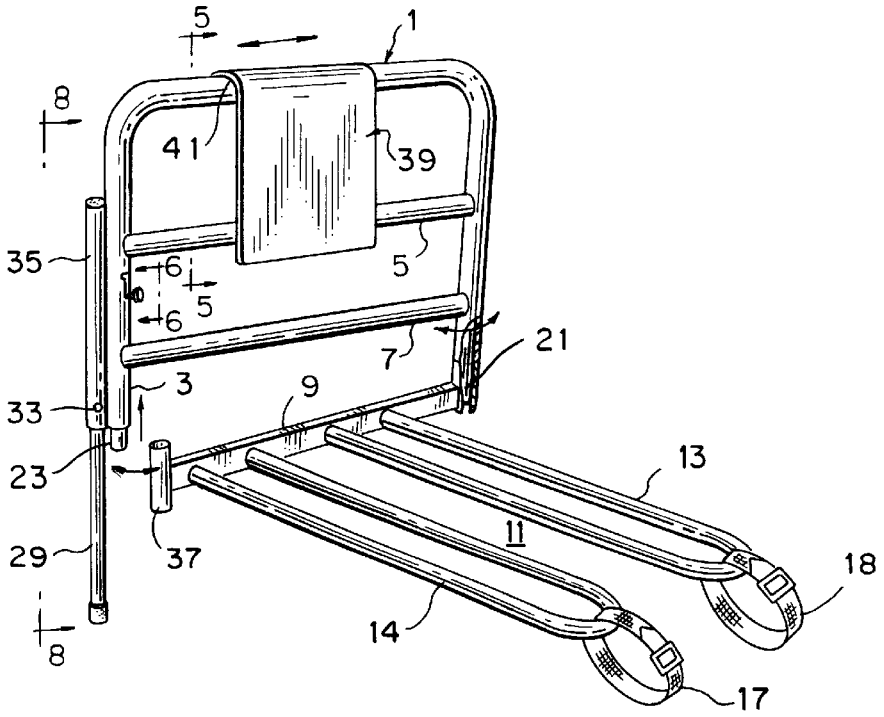
FIG. 2 is a perspective view of the embodiment shown in FIG. 1 in which the handrail attachment in is shown in a partially open position.
Figure 3:
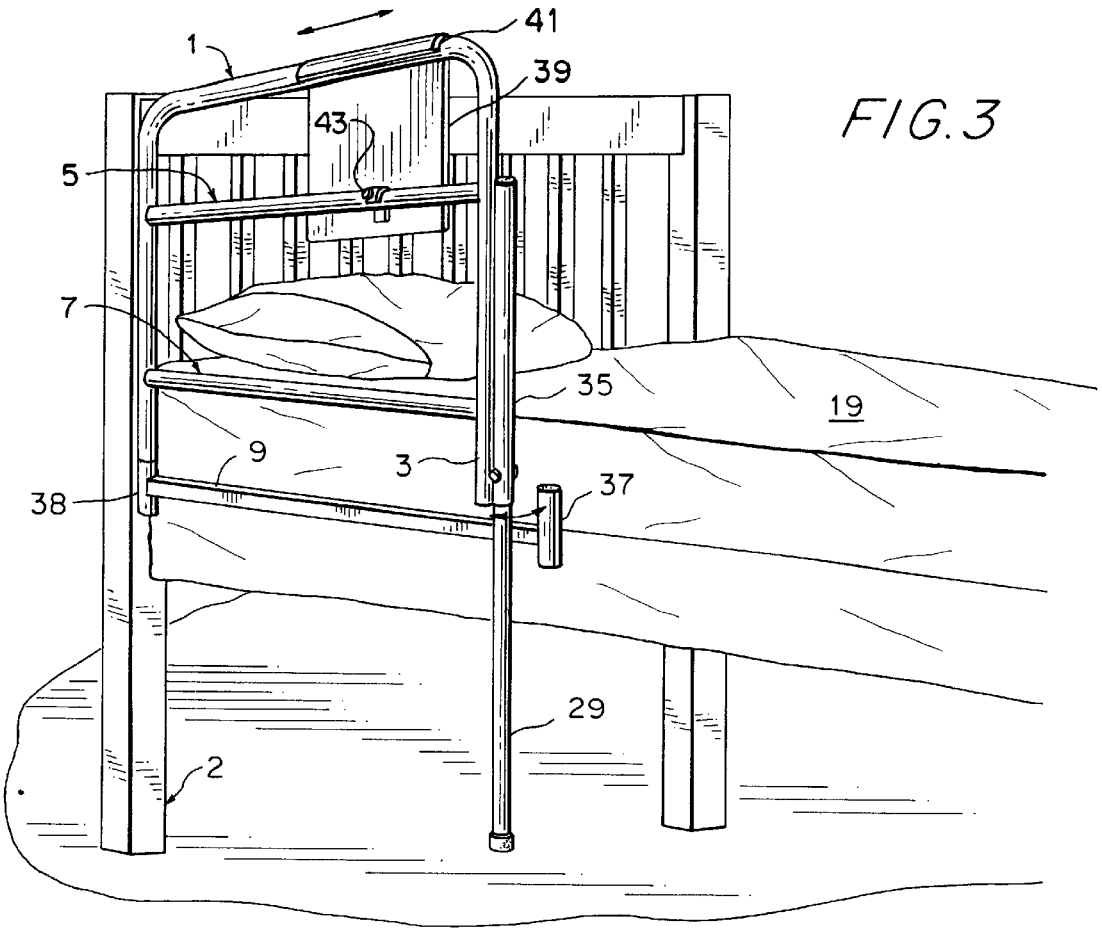
FIG. 3 is a perspective view showing the handrail in partially open position with the base member extending under the mattress of a bed.
Figure 4:
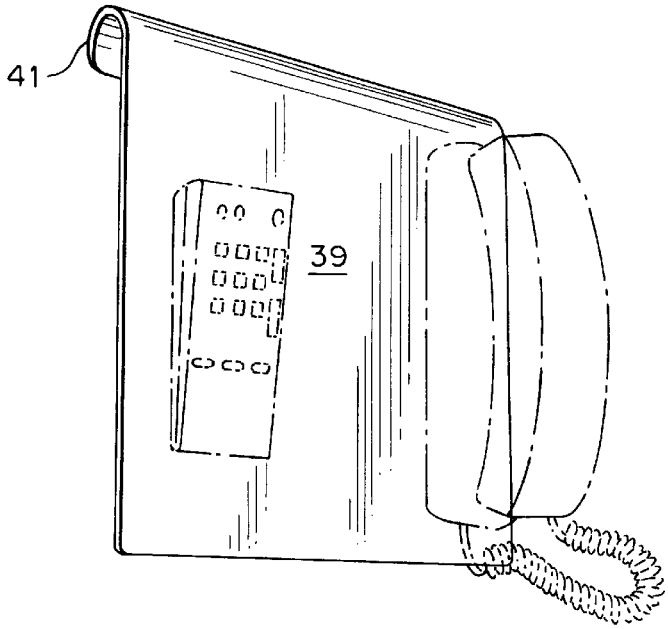
FIG. 4 is a perspective view of the removable plate member showing a phantom view of a television remote control and a telephone attached to the plate by flexible hook and eye fabric fasteners secured to their bottom surfaces (not shown)
Figure 5:
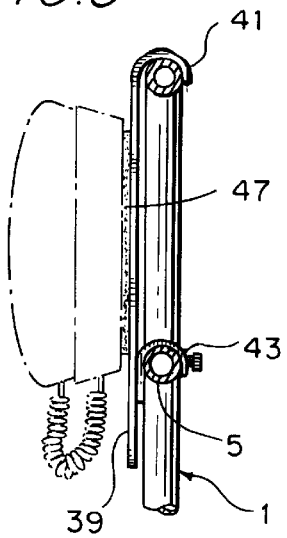
FIG. 5 is a cross-sectional view taken along line 5—5 shown in FIG. 2.
Figure 6:
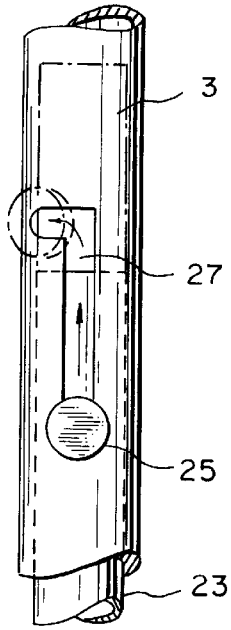
FIG. 6 is a view taken along line 6—6 in FIG. 2 showing the protruding knob member positioned in the modified L-shaped slot in a depending arm of the inverted U-shaped tubular member.
Figure 7:
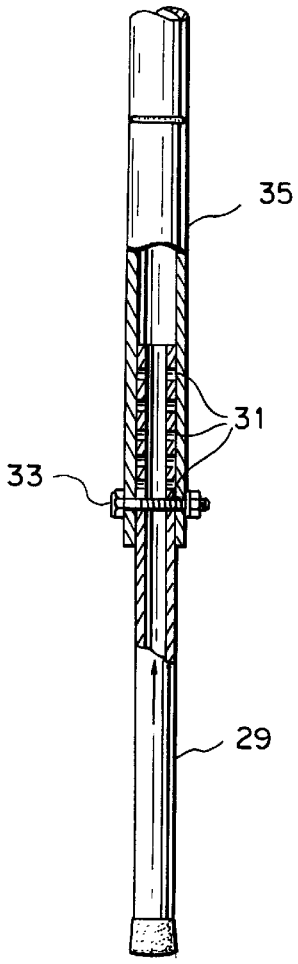
FIG. 7 is a cross-sectional view taken along line 7—7 in FIG. 1 showing detail of how the second slidable rod is positioned in the straight tubular member.
Figure 8:
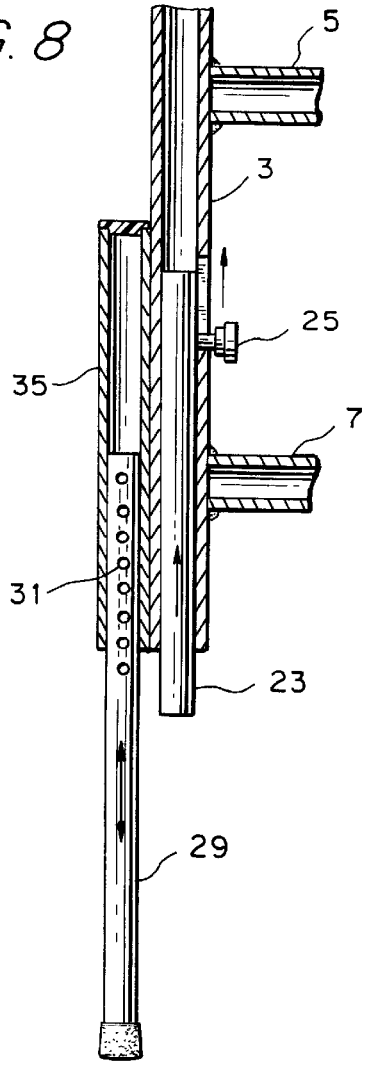
FIG. 8 is a cross-sectional view taken along line 8—8 in FIG. 2 showing detail of the functions of the first and second slidable rods.

The invention will be understood more readily by referring to the various figures of the drawing. FIG. 1 is a perspective view of the handrail attachment for beds positioned as it would be utilized on bed 2 and mattress 19, as shown in FIG. 3. The attachment is fastened to a bed rail 15 (shown in phantom view) by flexible strap members 17 and 18. The straps, together with the weight of the mattress and bed occupant, anchor the handrail attachment securely in position.

The attachment comprises an inverted U-shaped tubular handrail member 1 having a pair of vertically depending arm portions connected by cross-members 5 and 7. Depending arm portion 3 has a first slidable rod member 23 positioned in the lower end thereof. The slidable rod member 23 has a protruding knob member 25 fastened near its upper end. The protruding knob member fits within a modified L-shaped slot 27 located in depending arm portion 3 between cross-members 5 and 7.

The slidable rod member 23 serves to lock the inverted U-shaped tubular member 1 in place over base member 11, which comprises two U-shaped members 13 and 14 connected by cross-member 9. Cross-member 9 has hollow upstanding end portions 37 and 38 adapted to receive the first slidable rod 23 and a pivot pin member 21. The pivot pin member 21 serves as a hinge to enable the inverted U-shaped member 1 to swing between open and closed positions with respect to the base member 11. The slidable rod member 23 locks the inverted U-shaped member 1 in closed position when it is allowed to drop into the upper end of upstanding end portion 37 of the base member 11.

A straight tubular member 35 is fastened to depending arm portion 3. The straight tubular member 35 contains a second slidable rod member 29 having a series of holes spaced along its length so that the portion of slidable rod 29 extending below straight tubular member 35 can be adjusted in length to conform to the height of the bed from the floor. Bolt 33 is placed through hole 31 to fasten the second slidable rod 29 in position at a predetermined desired length, so that the inverted U-shaped tubular member 1 can serve as a stable support for the bed occupant in open position when it is swung away from the bed.

A removable plate member 39 has a curved top portion 41 positioned over the top rail of the inverted U-shaped tubular member and fastened in position by means of a depending curved tab and thumb screw 45. The removable plate member 39 provides a convenient support for items such as a telephone and television remote control which can be positioned within easy reach of the bed occupant. The items can be attached to removable plate member 39 by conventional means such as flexible hook and eye fabric fasteners, thereby permitting the items to be removed or rearranged as desired.

It will be obvious to those skilled in the art that modifications may be made to the preferred embodiment described herein without departing from the spirit of the invention, and the invention includes all such modifications.

What is claimed is:

1. An improvement in handrail attachments to be used in combination with a bed having sides with a mattress and conventional box springs supported on bedrails positioned along each side of the bed to provide both a guard rail and a hand-rail support for the bed occupant when shifting positions within the bed and getting in and out of the bed comprising an inverted U-shaped tubular handrail member having first and second vertically depending arms connected by first and second cross-members disposed in a vertical plane along the side of the bed, said vertically depending arms having ends;

a base member adapted to be inserted in a horizontal plane between the bed mattress and the box springs for receiving and supporting the ends of the vertically depending arms of the inverted U-shaped tubular handrail member;

said base member including first and second upstanding end portions of cross-sectional shape similar to the cross-sectional shape of the ends of the vertically depending arms of the inverted U-shaped tubular handrail member, whereby the ends of the vertically depending arms of the inverted U-shaped tubular handrail member abut the first and second upstanding end portions of the base member in flush relationship;

a pivot pin member fixedly mounted in the end of the first vertically depending arm of the inverted U-shaped tubular member and projecting therefrom to engage in telescopic relationship the first upstanding end portion of the base member, thereby maintaining the said first vertically depending arm and the said first upstanding end portion in vertical alignment while permitting pivotal movement of the inverted U-shaped tubular member;

a first slidable rod member positioned within the second vertically depending arm of the inverted U-shaped tubular handrail member and adapted to slide into the second upstanding end portion of the base member, thereby securing the inverted U-shaped tubular handrail member in an upstanding relationship with respect to the bed mattress;

a straight tubular member fastened to the second vertically depending arm of the inverted U-shaped tubular handrail member, said straight tubular member containing a second slidable rod member having a series of holes spaced along its length;

means for removably locking together said straight tubular member and said second slidable rod in a position selected to provide support for the inverted U-shaped tubular handrail member when the handrail member is swung into an open position;

whereby a stable handrail attachment is provided by the inverted U-shaped tubular handrail member when the first slidable rod member is in a first position within the second upstanding end portion of the base member in telescopic relationship, and the inverted U-shaped tubular handrail member can be pivoted away from the bed to permit easy access to and from the bed when the second slidable rod member is secured in a second position.

2. The combination according to claim 1 wherein a plate member is removably fastened in a vertical position to the inverted U-shaped tubular handrail member to provide a support for items secured thereto with removable fastening means, said plate member having a depending tab extending over said first cross-member and held in a snug relationship with a thumbscrew extending through a threaded hole in the tab.

3. The combination according to claim 1 wherein removable fastening means are provided to secure the base member to an opposite bed rail to provide additional stability and prevent the handrail attachment from shifting position with respect to the bed.

4. The combination according to claim 1 wherein said first slidable rod member has a protruding knob adapted to fit within a modified L-shaped slot in the second vertically depending arm of the inverted U-shaped tubular handrail member to allow controlled movement between upper and lower positions of the first slidable rod as it either locks the handrail in position on the side of the bed or allows it to move into an open position.

* * * * *